US005549373A

United States Patent [19]

Bustos

[11] Patent Number: 5,549,373

[45] Date of Patent: Aug. 27, 1996

[54] MERCHANDISING DISPLAY WITH MODULAR SHELVES

[75] Inventor: Rafael T. Bustos, Alpharetta, Ga.

[73] Assignee: L & P Property Management Company, Chicago, Ill.

[21] Appl. No.: 268,456

[22] Filed: Jun. 30, 1994

[51] Int. Cl.[6] ..... A47F 3/10

[52] U.S. Cl. ..... 312/135; 312/125; 312/305; 312/408; 312/285

[58] Field of Search ..... 312/135, 116, 312/125, 305, 97.1, 36, 72, 73, 408, 285, 249.2; 108/93, 90, 94; 211/74, 153, 49.1; 206/562, 563, 564

[56] References Cited

U.S. PATENT DOCUMENTS

| | | | |
|---|---|---|---|
| Re. 30,706 | 8/1981 | Bustos . | |
| D. 268,068 | 3/1983 | Ellenson et al. . | |
| 285,386 | 8/1883 | Burton | 211/74 |
| D. 349,829 | 8/1994 | Bustos . | |
| 470,022 | 3/1892 | Tuthill . | |
| 791,101 | 5/1905 | Klein | 312/135 |
| 986,875 | 3/1911 | Tilghman | 312/116 X |
| 1,471,594 | 10/1923 | Evans | 211/74 X |
| 1,883,961 | 10/1932 | Kosmerl . | |
| 1,939,800 | 12/1933 | Warren . | |
| 1,941,906 | 1/1934 | Marinsky . | |
| 2,025,416 | 12/1935 | Limerick, Jr. | 312/135 X |
| 2,066,865 | 1/1937 | Warner . | |
| 2,087,797 | 7/1937 | Cox et al. . | |
| 2,217,810 | 10/1940 | Pape . | |
| 2,272,859 | 2/1942 | Wilsey | 312/97.1 X |
| 2,299,347 | 10/1942 | Rifkin . | |
| 2,314,935 | 3/1943 | Gutterman | 206/563 |
| 2,499,088 | 2/1950 | Brill et al. . | |
| 2,574,164 | 11/1951 | Baay | 312/125 X |
| 2,888,306 | 5/1959 | Sease et al. | 312/135 X |
| 2,895,609 | 7/1959 | Rajotte | 211/74 X |
| 2,949,018 | 8/1960 | Parsell . | |
| 3,010,290 | 11/1961 | Fredrick . | |
| 3,774,774 | 11/1973 | Menkel | 211/74 X |
| 4,030,608 | 6/1977 | Howard | 108/94 X |
| 4,293,062 | 10/1981 | Bustos . | |
| 4,351,439 | 9/1982 | Taylor . | |
| 4,523,439 | 6/1985 | Denisot . | |
| 4,663,943 | 5/1987 | Dyment et al. . | |
| 4,762,235 | 8/1988 | Howard et al. . | |
| 4,765,492 | 8/1988 | Howard et al. . | |
| 4,783,130 | 11/1988 | Twellmann | 312/125 X |
| 4,794,764 | 1/1989 | Dyment et al. . | |
| 4,809,855 | 3/1989 | Bustos . | |
| 5,056,332 | 10/1991 | Tajima et al. | 312/116 X |
| 5,277,486 | 1/1994 | Bustos . | |

FOREIGN PATENT DOCUMENTS

| | | | |
|---|---|---|---|
| 1315964 | 12/1962 | France . | |
| 2952779 | 7/1981 | Germany | 312/116 |

*Primary Examiner*—Peter M. Cuomo
*Assistant Examiner*—Janet M. Wilkens
*Attorney, Agent, or Firm*—Wood, Herron & Evans, P.L.L.

[57] ABSTRACT

Apparatus for merchandising product including an enclosure having circular, rotatable shelves each including compartmentalized portions which are product specific. The merchandising display apparatus is particularly suitable for displaying refrigerated or frozen products such as frozen dessert products. Each shelf is formed by a lower shelf support which may receive shelves having differently configured compartments for receiving different products. The shelves are modular in the sense that they may be removed and replaced with different shelves such that the merchandising display may be adapted to hold many varied types of products.

27 Claims, 8 Drawing Sheets

FIG.3
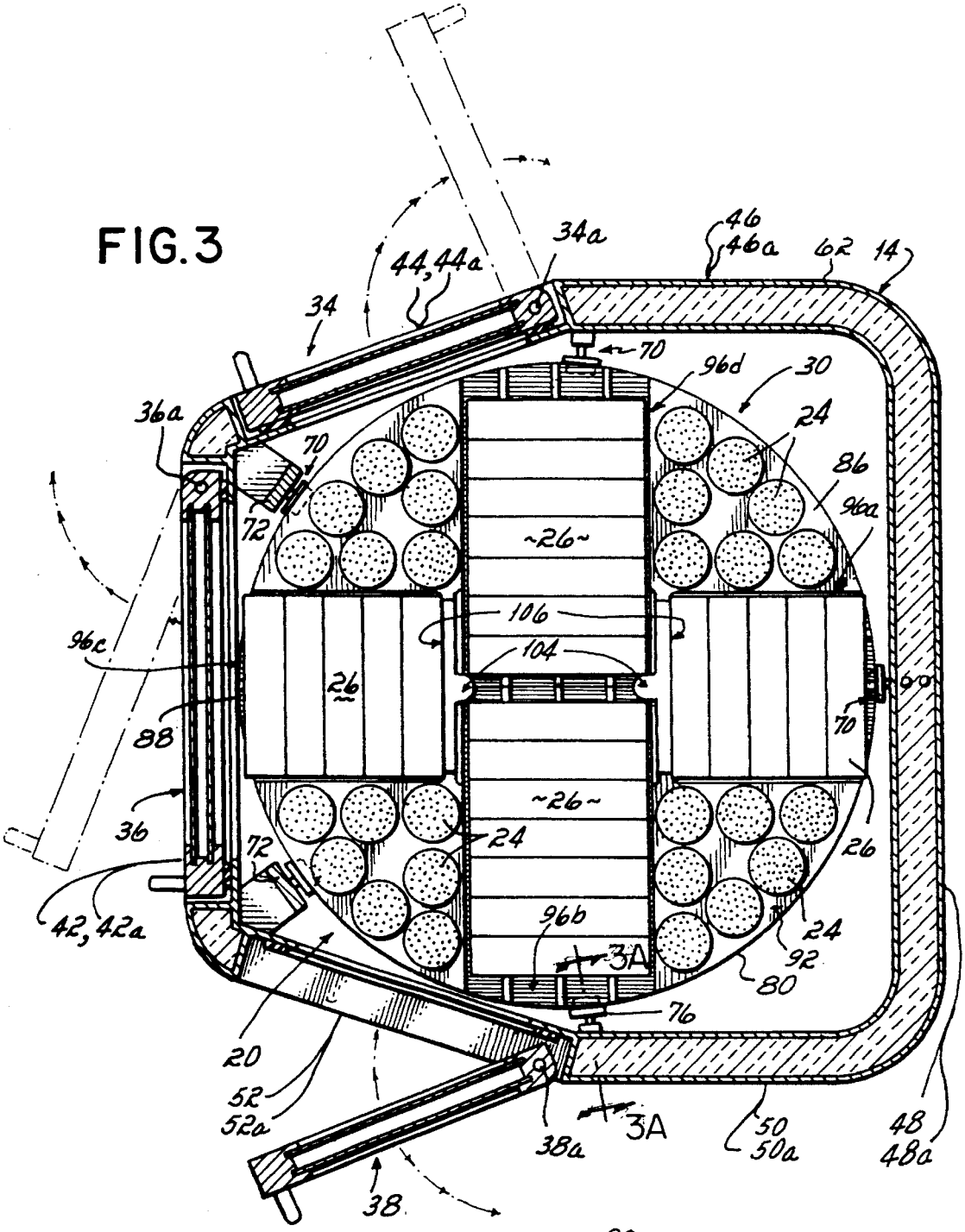
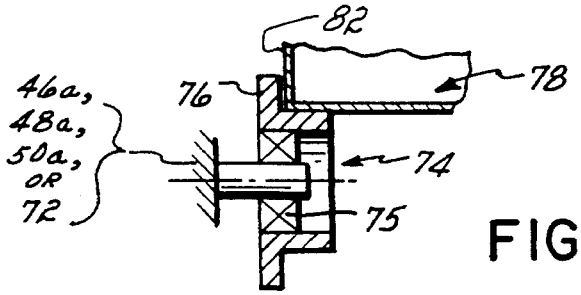
FIG.3A

MERCHANDISING DISPLAY WITH MODULAR SHELVES

BACKGROUND OF THE INVENTION

This invention relates to a display for merchandising products and, more particularly, to a display for merchandising frozen dessert products such as frozen ice cream novelty products. Specifically, this invention relates to an improved shelf design for displaying such products within a refrigerated merchandising display unit.

Merchandising displays are commonly used in supermarkets as well as other types of stores to display and merchandise items which are generally handled as self-service items. It has been regular practice in this area to display such self-service ice cream products in freezer sections having racks wherein the products are arranged on shelves in adjacent rows parallel to the shelf's front edge. Often, and especially in the area of ice cream novelty products, the products are kept in their shipping cartons which are merely placed within the freezer and either opened by the store personnel or by the customer so that product may be removed and purchased. Also, it has been general practice in the past to place different types of products in different sections of the frozen food department of a store such that the customer cannot access different types of frozen desert products, for example, from one freezer section.

One merchandising display to which the present invention is generally related is disclosed in U.S. Pat. No. 5,277,486 (the '486 patent), assigned to the assignee of this application and hereby fully and expressly incorporated by reference herein. The merchandising display disclosed in this patent includes round, rotatable shelves which rotate by gravity under the weight of the product contained on the shelves. In this way, the shelves constantly feed product toward the front of the display. The display disclosed in the '486 patent further contemplates a unique shape which provides efficient air circulation throughout the display's product compartment. The merchandising display of the '486 patent was specifically directed to the display and refrigeration of beverage products and therefore included rather simple, pan-shaped shelves for holding the beverage products.

It has become apparent that it would be desirable to have a merchandising display for holding and displaying at the point of purchase, for example, multiple and varied types of products such as frozen dessert products or ice cream products for customers to choose from and purchase at one location.

SUMMARY OF THE INVENTION

It has therefore been an object of this invention to provide a merchandising display which contains uniquely designed shelves adapted to hold and display various types of products.

It has been another object of this invention to provide a modular shelf design wherein the shelves may be easily removed and replaced by shelves having other configurations designed to hold products in differently shaped containers.

It has been a further object of the invention to provide a shelf which is designed to hold and display a variety of differently shaped product containers.

To these ends, the present invention is embodied in a merchandising display including a housing having an enclosed display compartment and at least one door mounted on a front side of the housing through which access may be gained to the display compartment. In accordance with one aspect of the invention, the display compartment includes at least one generally circular modular shelf assembly which includes a shelf support and a product shelf. The product shelf is removably attached to the shelf support to allow different product shelves to be selectively attached to the shelf support. Preferably, the shelf support is a generally circular support pan and the product shelf is a generally circular shelf unit received on top of the support pan. The support pan includes an upstanding peripheral lip and the shelf unit includes a downwardly depending peripheral lip with these lips being disposed adjacent one another in the shelf assembly. Preferably, all of the shelf assemblies are supported for rotation within the display compartment.

In accordance with another aspect of the invention the merchandising display includes at least one generally circular shelf supported within the display compartment with the shelf including first and second differently configured product receiving portions for respectively receiving first and second differently shaped products. In the preferred embodiment, the display compartment is operatively connected to a refrigeration unit and the product receiving portions are configured to receive different refrigerated or frozen products. One of the product receiving portions includes an upper surface having holes for receiving products. This upper surface is inclined downwardly toward the periphery of the shelf. Another of the product receiving portions is a product compartment having a bottom surface, a pair of vertical side support surfaces and a stop surface disposed proximate a central area of the shelf. In this product compartment products, such as boxed ice cream products, may be displayed between the side support surfaces and against the stop surface. The bottom surface of this product compartment is inclined upwardly from approximately the stop surface to the periphery of the shelf.

In the preferred embodiment of this aspect of the invention, the shelf having first and second differently configured product receiving portions includes four upper surfaces having holes for receiving products. The four upper surfaces are separated by four product compartments and the upper surfaces are each part of an upstanding pie-shaped structure. The pie-shaped structures have outer side wall surfaces and the outer side wall surfaces of adjacent pie-shaped structures form the vertical side support surfaces of the product compartments contained therebetween. Two of the stop surfaces defining first and second product compartments are on respective first and second upstanding walls disposed at the inner end of each of the first and second product compartments. A side of each upstanding wall opposite to the stop surface thereof further defines a portion of respective third and fourth product compartments, The third and fourth product compartments are partially defined by stop surfaces disposed on first and second vertically oriented tab members extending, respectively, from the first and second upstanding walls. The first and second tab members are located centrally of two ends of the first and second upstanding walls.

In another aspect of the invention at least one generally circular shelf having a number of holes in an upper surface thereof is provided and adapted to be rotatably supported in the display compartment. Specifically, the shelf has an upper surface inclined downwardly toward a peripheral edge of the shelf and including a plurality of holes therein for receiving and display products, such as frozen, prepackaged ice cream cones. Each hole includes an annular flange portion extending from the upper surface of the shelf and providing side support for a product extending through the hole.

In still another aspect of the invention at least one generally circular shelf having a plurality of upstanding, radially extending partitions is provided and adapted to be rotatably supported in the display compartment. The partitions separate the upper surface of the shelf into a plurality of compartments and each partition includes two side surfaces comprising a plurality of recesses for receiving and displaying products. Preferably, these recesses are shaped generally as part of a cylinder and are thereby adapted to hold generally cylindrical product containers. The shelf more specifically has three partitions extending radially at positions spaced approximately 120° apart and three of the recesses are located within junctions created between adjacent partitions. Upper surface portions disposed between adjacent partitions are inclined upwardly toward the periphery of said shelf.

These and other objects and advantages of the invention will become more readily apparent to those of ordinary skill in the art upon review of the following detailed description taking in conjunction with the accompanying drawings.

BRIEF DESCRIPTION OF THE DRAWINGS

FIG. 3 is a cross-sectional view taken along line 3—3 of FIG. 2;

FIG. 3A is a cross-sectional view taken line 3A—3A of FIG. 3;

DETAILED DESCRIPTION OF THE PREFERRED EMBODIMENT

Figure 1:
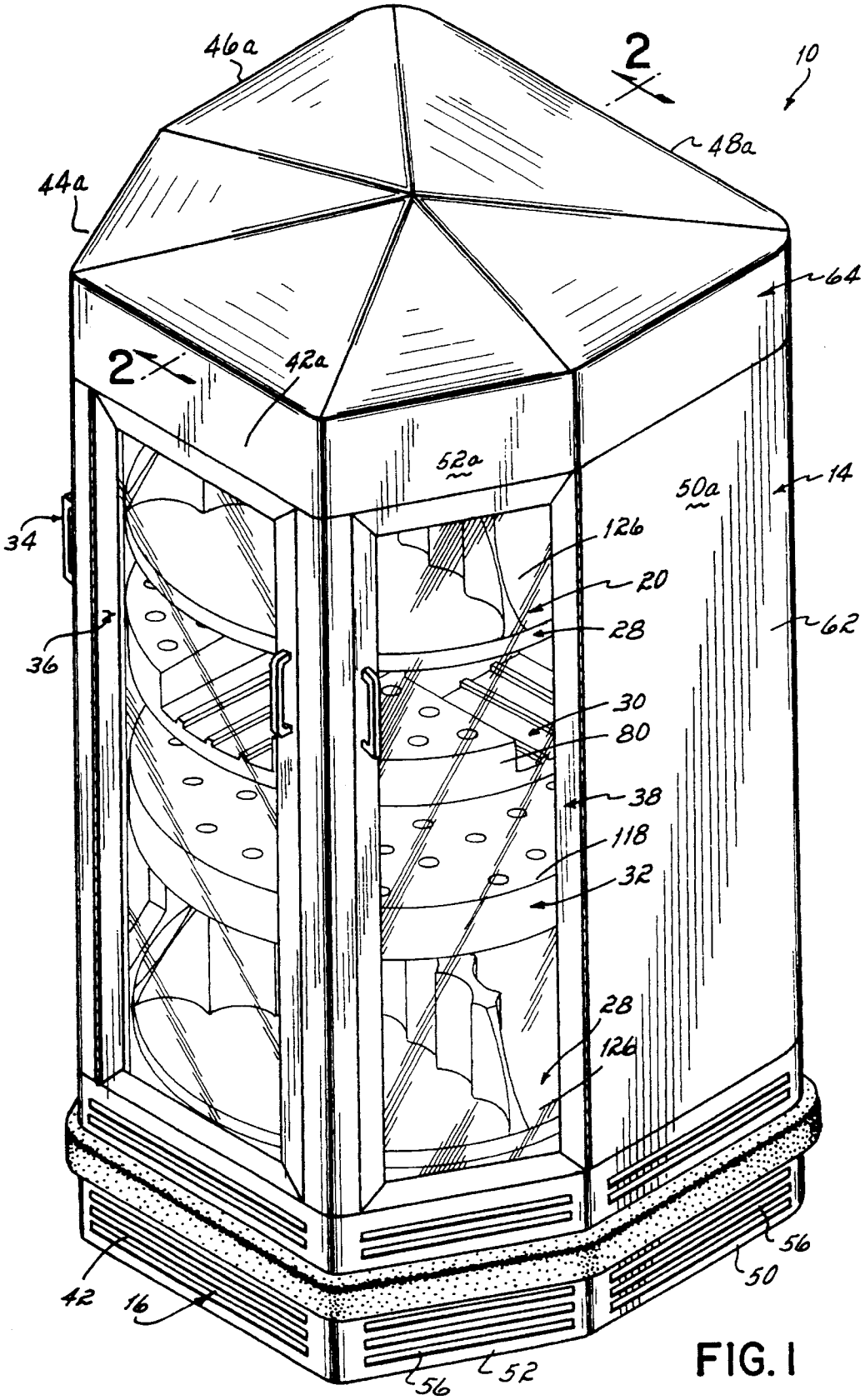
FIG. 1 is a perspective view of a merchandising display unit incorporating one illustrative configuration of shelves constructed according to the present invention.

Referring first to FIG. 1, there is illustrated a refrigerated merchandising display 10 incorporating the present invention. This 15 display 10 is specifically designed to merchandise frozen food products, especially frozen ice cream novelty products. It could also, however, be utilized to merchandise other products whether refrigerated or not.

Figure 2:
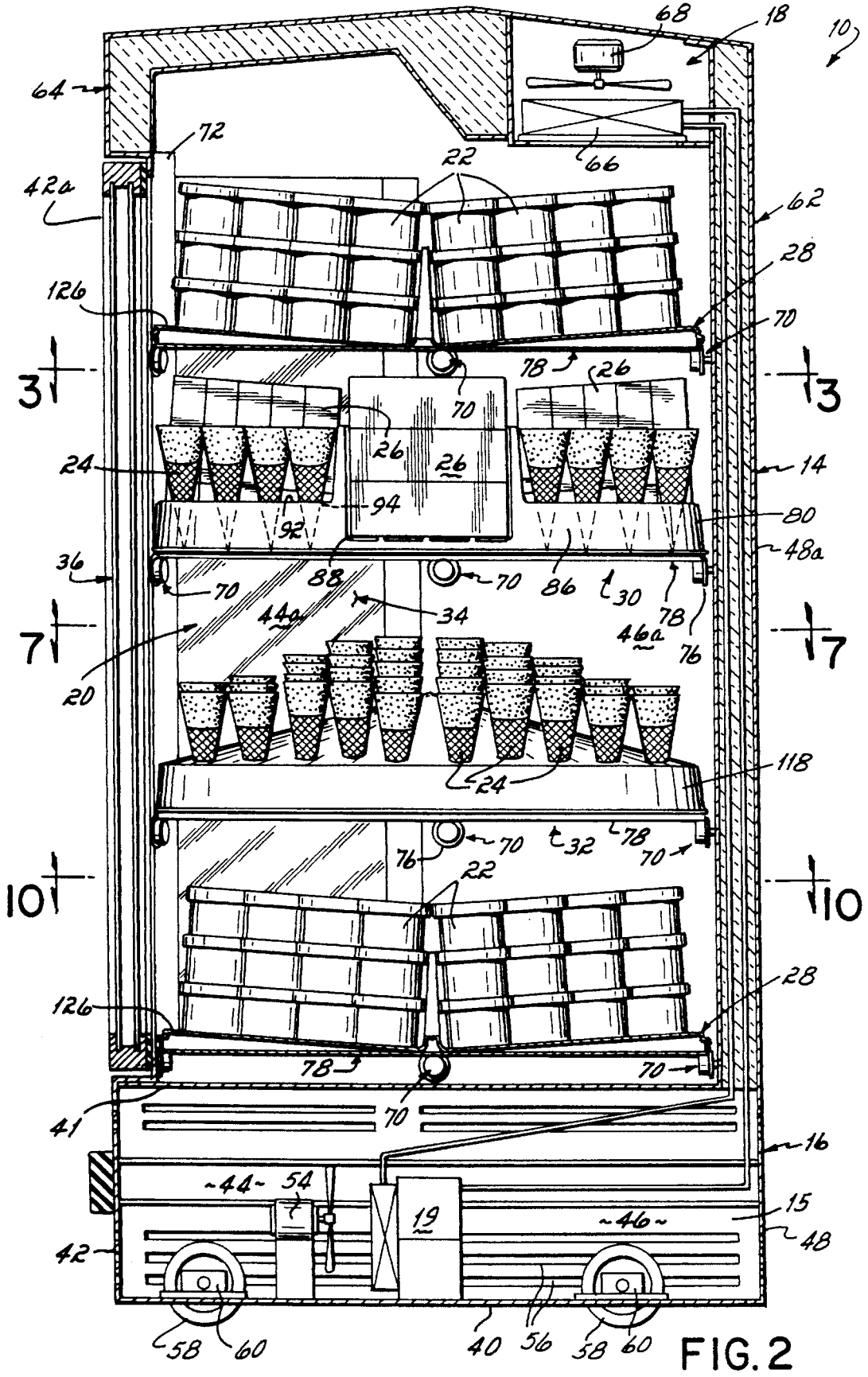
FIG. 2 is a side cross-sectional view of the merchandising display unit taken along line 2—2 of FIG. 1 and showing various ice cream novelty products contained on the shelves of the display.

As shown best in FIG. 2, display 10 comprises a housing 14 in the base 16 of which there is located a base storage compartment 15 for the compressor portion 19 of a refrigeration unit 18. The structure of housing 14 may be substantially identical to the structure disclosed in the herein incorporated '486 patent. The upper portion of housing 14 defines an enclosed compartment 20 for the storage and display of refrigerated or frozen product 22, 24, 26. Within compartment 20 there are a plurality of rotatable shelf assemblies 28, 30, 32 constructed in accordance with preferred embodiments of the invention and upon which product 22, 24, 26 is supported in various configurations discussed in more detail below.

Figure 7:
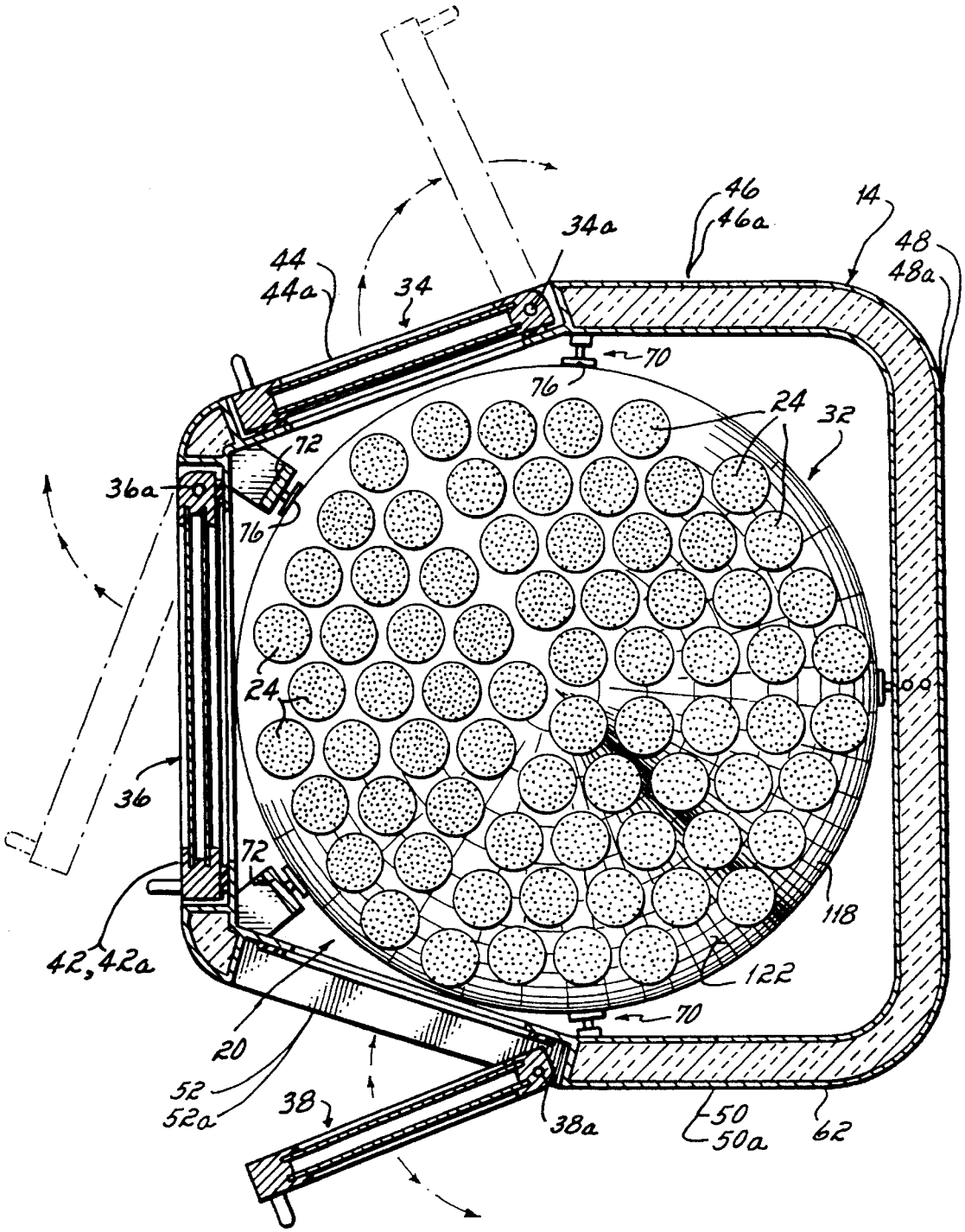
FIG. 7 is a cross-sectional view of the merchandising display taken along line 7—7 of FIG. 2.
Figure 10:
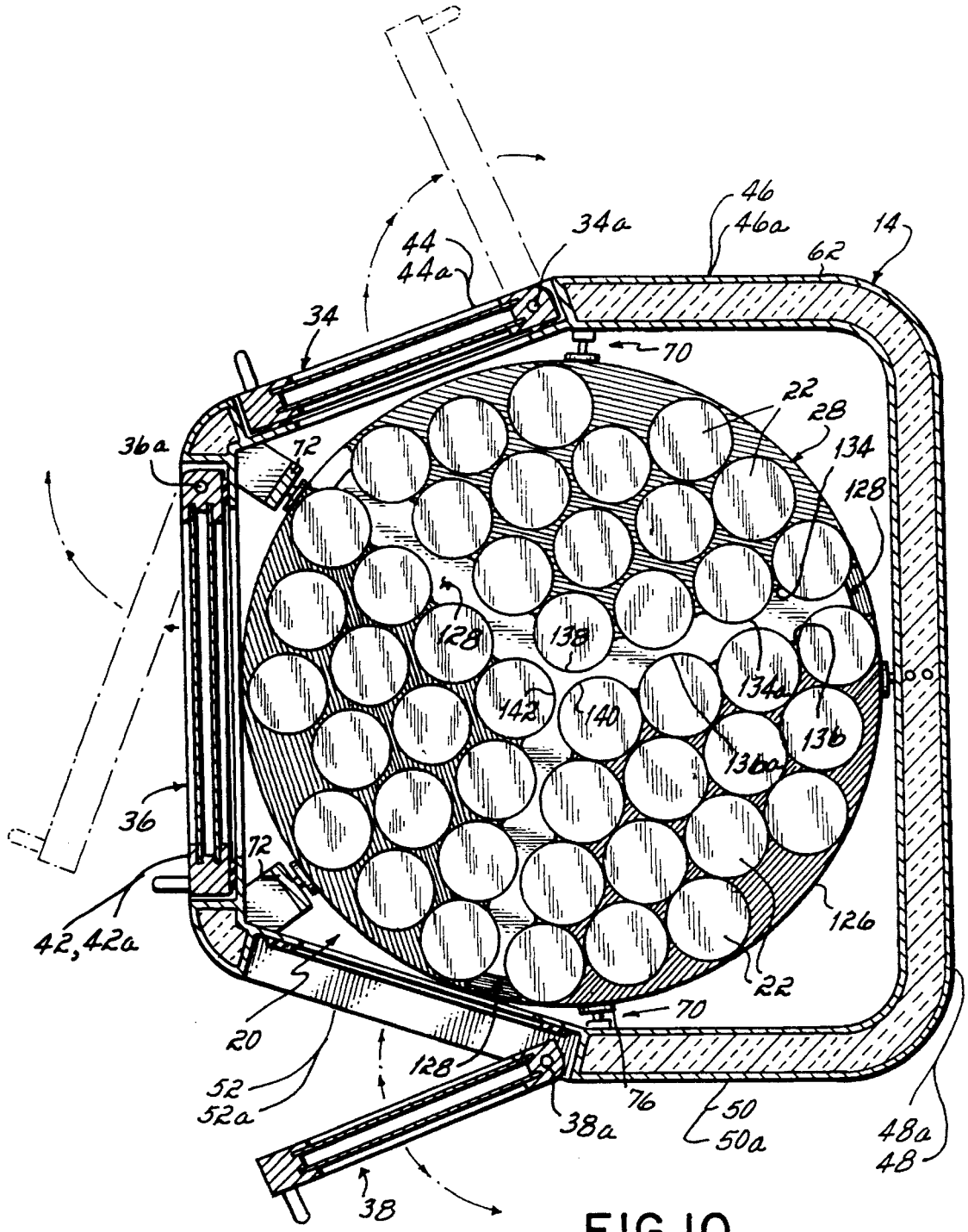
FIG. 10 is a cross-sectional view of the merchandising display taken along line 10—10 of FIG. 2.

As best shown in FIGS. 3, 7 and 10, access to compartment 20 is gained preferably through three doors 34, 36, 38 located generally on the front side of housing 14. The doors 34, 36, 38 are also preferably designed to open centrally of the front side of housing 14 and include respective spring hinges 34*a*, 36*a*, 38*a* which maintain the doors 34, 36, 38 in a normally closed position. As is conventional in the art, the doors may be latched shut with conventional magnetic or mechanical latches which form no part of the present invention and therefore are not shown.

Referring to FIG. 2 taken in conjunction with FIG. 3, for example, base 16 of housing 14 comprises a bottom wall 40, a top wall 41 and six vertical walls 42, 44, 46, 48, 50 and 52. These vertical walls comprise a front wall 42, a pair of side walls 44, 52 diverging rearwardly from the front wall 42, a pair of parallel rear side walls 46, 50 and a rear wall 48. Contained within the base storage compartment 15 is compressor 19 of refrigeration unit 18 and a fan 54 operative to direct ambient air over fins of compressor 19 to cool it. This ambient air is permitted to flow into and out of base storage compartment 15 through openings or louvers 56 in the vertical walls of base 16.

Base 16 is preferably supported upon wheels or casters 58 which extend downwardly through the bottom wall 40 of base 16. Wheels 58 are rotatably mounted on brackets 60 secured to bottom wall 40 such that wheels 58 are free to rotate and allow the display 10 to be easily moved within a supermarket or other merchandising facility within which display 10 is utilized.

Mounted atop base 16 is the upper portion 62 of housing 14. This upper portion encloses the storage and display compartment 20 within which the refrigerated or frozen product 22, 24, 26 is stored and displayed. As shown in FIGS. 3, 7 and 10, upper portion 62 is of the same hexagonal cross-sectional configuration as base 16. Specifically, upper portion 62 comprises a front wall 42*a*, a pair of side walls 44*a*, 52*a* diverging rearwardly from the front wall 42*a*, a pair of parallel rear side walls 46*a*, 50*a* and a rear wall 48*a*. As in the '486 patent, all upper walls are preferably insulated to prevent refrigeration loss. As also disclosed in the '486 patent, display 10 further includes an upper cap 64 having the same cross-sectional hexagonal shape as upper portion 62 and base 16. As shown in FIG. 2, a heat exchanger or radiator 66 and fan unit 68 comprising refrigeration unit 18 are disposed within cap 64. All refrigeration components operate to cool compartment 20 in the manner disclosed in the '486 patent and further discussion herein is therefore unnecessary.

Turning briefly to FIGS. 3 and 3A, each shelf assembly is preferably mounted for rotation within compartment 20. Specifically, a plurality of roller units 70 are mounted to housing 14 within compartment 20 along spaced peripheral portions of each shelf assembly 28, 30, 32 as shown respectively in FIGS. 3, 7 and 10. As shelf assembly 30 shown in FIG. 3 is representative of the rotatable mounting of each shelf assembly, the rotatable mounting of each will be sufficiently described with reference only to FIGS. 3 and 3A. Two front roller units 70 are mounted to housing 14 by way of brackets 72 while three rear roller units 70 are mounted directly to rear walls 46, 48, 50. As shown in FIG. 3A, each roller unit 70 comprises a wheel or roller 74 rotatably fixed to a bearing 75 and further includes an outwardly extending flange 76 disposed adjacent to lip 82 of support pan 78. Thus, as shelf assembly 30 is rotated, 15 wheels or rollers 74 support the weight of shelf assembly 30 and the products 24, 26 disposed thereon while also turning to allow the rotation to take place within the confines of the five flanges 76 disposed about the periphery of support pan 78.

Figure 5:
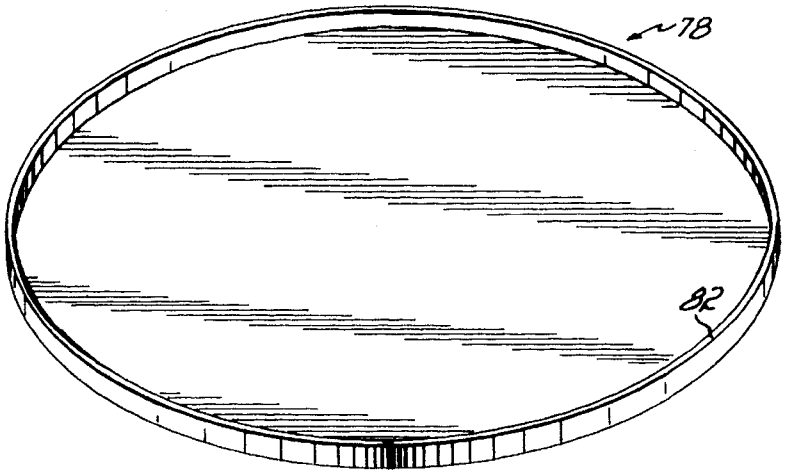
FIG. 5 is a perspective view of the base support pan of the invention which is designed to support any one of the shelves constructed according to the invention.
Figure 4:
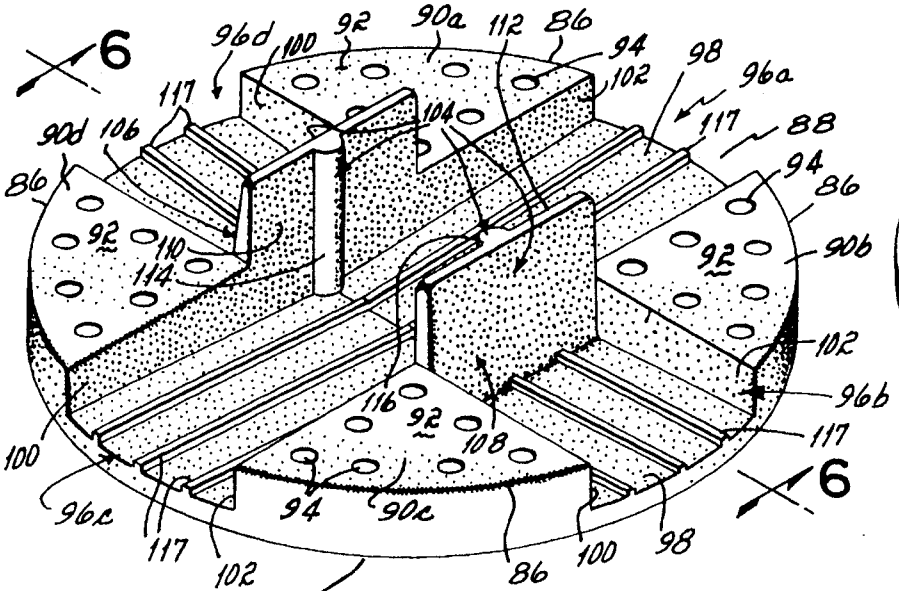
FIG. 4 is a perspective view of one shelf constructed according to the present invention and designed to hold two different types of ice cream novelty products.
Figure 6:
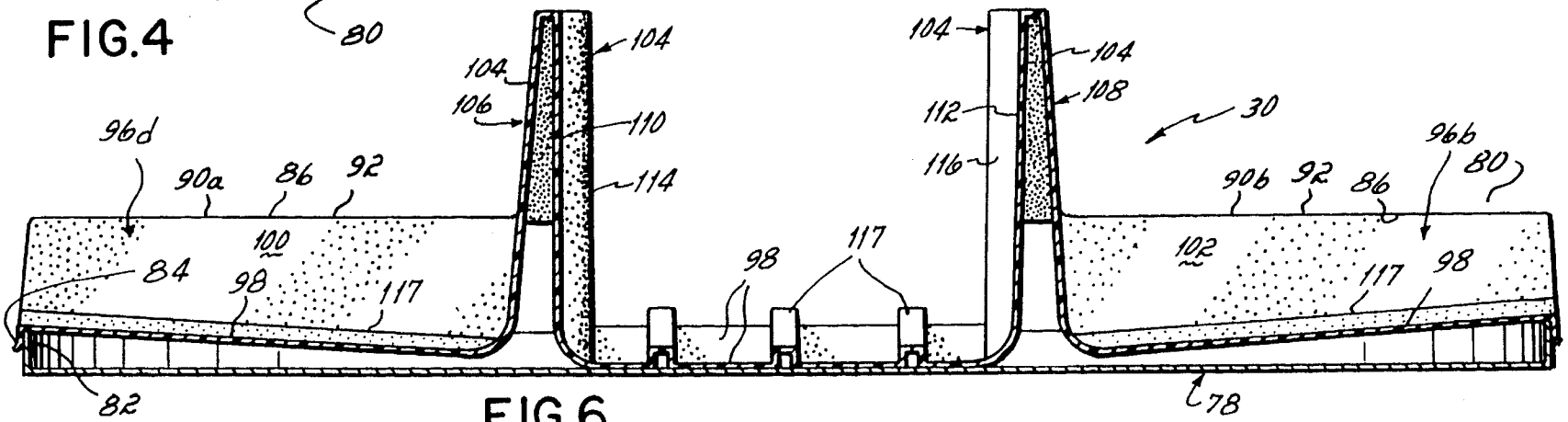
FIG. 6 is a cross-sectional view of the shelf shown in FIG. 4 taken along line 6—6 thereof.

FIGS. 4–6 illustrate the components of a shelf assembly 30 constructed in accordance with one aspect of the invention. Specifically, shelf assembly 30 comprises a shelf support 78 and a product shelf 80. Product shelf 80 is removably attached to shelf support 78 to allow different product shelves to be selectively attached to the shelf support 78. Preferably, shelf support 78 is a generally circular support pan and product shelf 80 is also generally circular and is received on top of the support pan. The shelf support or support pan 78 includes an upstanding peripheral lip 82 while product shelf 80 includes a downwardly depending peripheral lip 84, Lips 82, 84 are disposed adjacent one another when support pan 78 and product shelf 80 are assembled. More particularly, and as shown in FIG. 6, lip 82 is received inside of or radially inwardly of lip 84 after assembly, preferably producing a slight frictional fit between support pan 78 and shelf 80, It will be appreciated upon further review of this description that each shelf assembly 28, 30, 32 is constructed in accordance with this aspect of the invention such that the differently configured removable product shelves of each assembly may be interchanged depending on the desires of the user.

In accordance with another aspect of the invention, and as best shown in FIGS. 3, 4 and 6, product shelf 80 generally includes first and second differently configured product receiving portions 86, 88 for respectively receiving first and second differently shaped products, such as ice cream cones 24 and boxed ice cream novelty products 26 (FIG. 3), respectively. Product receiving portion 86 comprises raised pie-shaped structures 90*a*, 90*b*, 90*c* and 90*d* each including a planar upper surface 92 having holes 94 for receiving products such as ice cream cones 24. This upper surface 92 may be inclined downwardly toward the periphery of shelf 80. Product receiving portion 88 of shelf 80 comprises product compartments 96*a*, 96*b*, 96*c* and 96*d* each having a bottom surface 98, a pair of vertical side support surfaces 100, 102 and a stop surface 104 disposed proximate a central area of the shelf 80. In these product compartments 96*a*, 96*b*, 96*c* and 96*d* products, such as boxed ice cream products 26, may be displayed between the side support surfaces 100, 102 and against the stop surface 104 of the particular compartment. As shown in FIGS. 4 and 6, the bottom surface 98 of each product compartment 96*a*, 96*b*, 96*c* and 96*d* is inclined upwardly from approximately the stop surface 104 of the compartment to the periphery of the shelf 80.

As illustrated best in FIGS. 3 and 4, pie-shaped structures 90*a*, 90*b*, 90*c* and 90*d* are separated by the product compartments 96*a*, 96*b*, 96*c* and 96*d*. The upstanding outer side walls of adjacent pie-shaped structures, e.g., structures 90*a* and 90*b*, form the vertical side support surfaces 100, 102 of the product compartment, e.g., compartment 96*a*, which is located therebetween.

Referring to FIGS. 4 and 6, two of the stop surfaces 104 defining product compartments 96*b* and 96*d* are on respective first and second upstanding walls 106, 108 disposed at the inner end of each of product compartment 96*b* and 96*d*. Sides 110, 112 of respective upstanding walls 106, 108 which are opposite to the stop surface side 104 thereof further define portions of product compartments 96*a* and 96*c*. Product compartments 96*a*, 96*c* are also defined by stop surfaces 104 disposed on first and second vertically oriented tab members 114, 116 extending, respectively, from sides 110, 112 of upstanding walls 106, 108. The first and second tab members 114, 116 are located centrally of two ends of the first and second upstanding walls 106, 108 and are generally semi-cylindrically shaped. Bottom surfaces 98 of compartments 96*a*, 96*b*, 96*c* and 96*d* have a plurality of raised ribs 117 extending lengthwise toward the periphery of shelf 80 on which the product 26 is placed. As further shown in FIG. 6, shelf 80 is removably supported on a support pan 78 as previously described.

Figure 8:
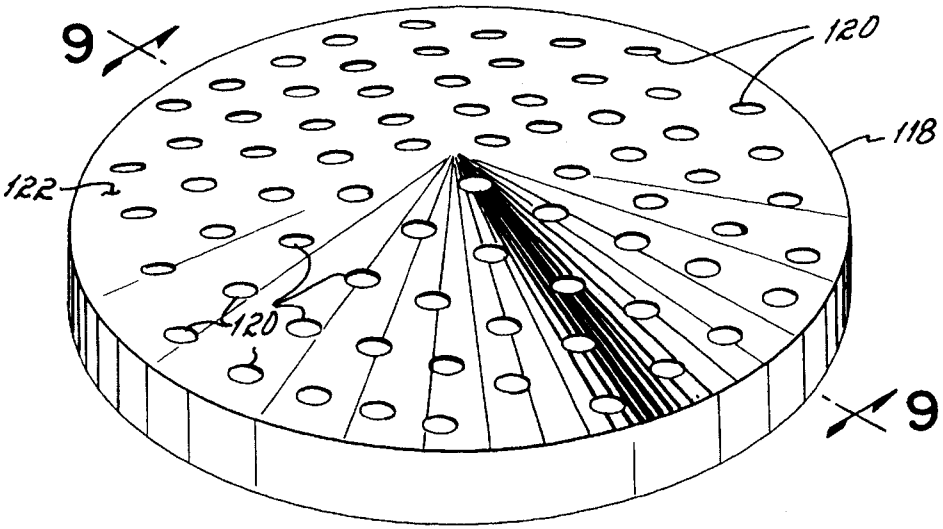
FIG. 8 is a perspective view of another shelf constructed in accordance with the invention.
Figure 9:
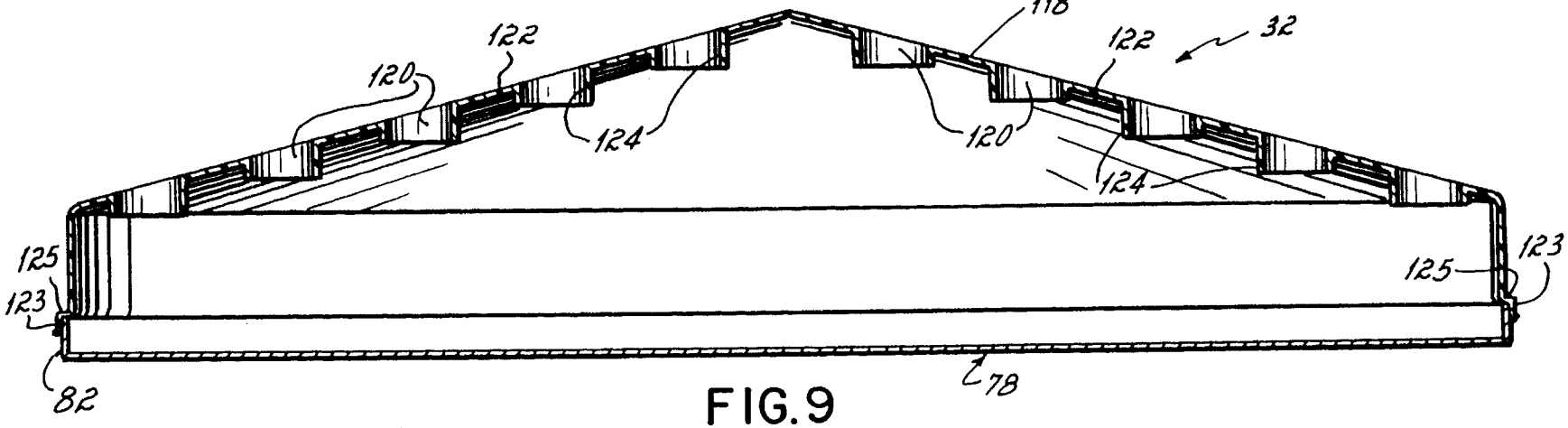
FIG. 9 is a cross-sectional view of the shelf illustrated in FIG. 8 taken along line 9—9 thereof.

Referring now to FIGS. 7–9, in accordance with another aspect of the invention, a circular shelf 118 having a number of holes 120 in an upper surface thereof is provided and adapted to be rotatably supported in the display compartment 20. Specifically, 15 shelf 118 has an upper surface 122 inclined downwardly toward a peripheral edge of shelf 118 and including a plurality of holes 120 therein for receiving and display products, such as frozen, prepackaged ice cream cones 24 (see FIGS. 2 and 7). As particularly shown in FIG. 9, each hole 120 includes an annular flange portion 124 extending downwardly from the upper surface 122 of shelf 118 and providing side support for a product extending through the hole 120. As further shown in FIG. 9, shelf 118 is removably supported on a support pan 78 in the manner generally described with respect to shelf 80. In this regard, a downwardly depending peripheral lip 123 receives lip 82 radially inwardly thereof. The top of lip 82 engages an outwardly extending flange 125 connected to lip 123 of shelf 118 to provide the necessary support.

Figure 11:
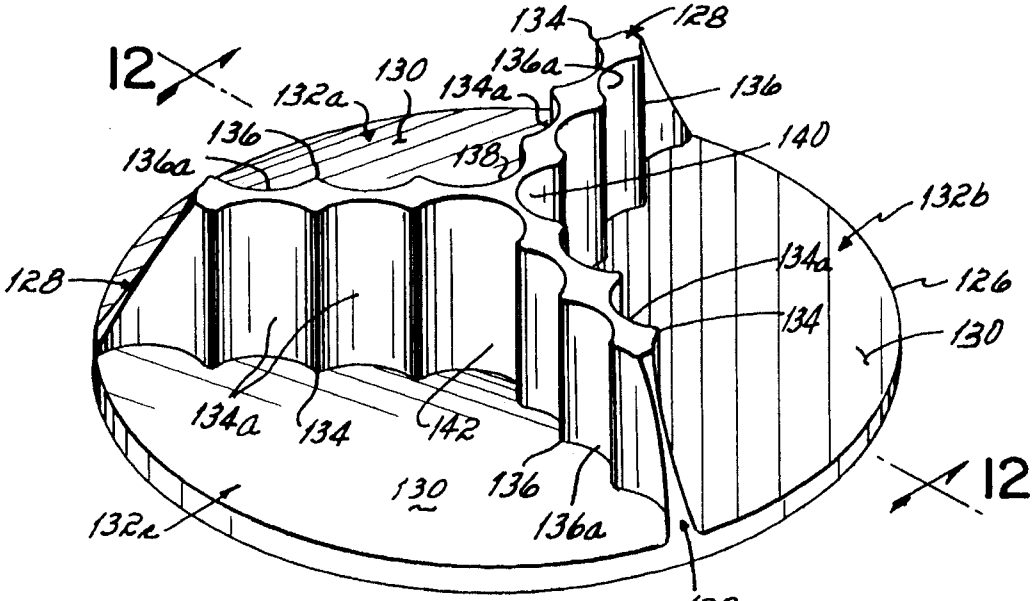
FIG. 11 is a perspective view of another shelf constructed in accordance with the invention.
Figure 12:
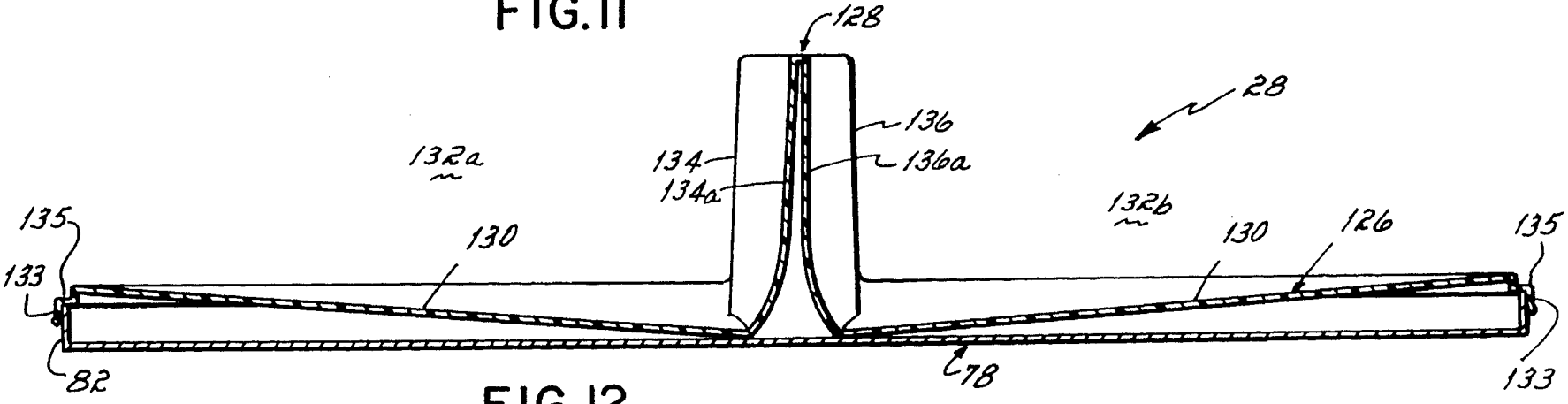
FIG. 12 is a cross-sectional view of the shelf illustrated in FIG. 11 taken along line 12—12 thereof.

FIGS. 10–12 illustrate shelf assembly 28 of the present invention. Specifically, shelf assembly 28 includes a generally circular, rotatable shelf 126 having a plurality of upstanding, radially extending partitions 128. Partitions 128 separate an upper surface 130 of shelf 126 into a plurality of compartments 132*a*, 132*b*, 132*c*. Each partition 128 includes two side surfaces 134, 136 comprising a plurality of recesses 134*a*, 136*a* for receiving product containers 22. Preferably, recesses 134*a*, 136*a* are concavely shaped generally as part of a cylinder and are thereby adapted to hold generally cylindrical product containers or cups 22. Shelf 126 more specifically has three partitions 128 extending radially at positions spaced approximately 120° apart. Aside from recesses 134*a* and 136*a*, three additional recesses 138, 140 and 142 are located within junctions created between adjacent partitions 128. Portions of upper surface 130 disposed between adjacent partitions 128 are inclined upwardly toward the periphery of shelf 126 as shown in FIG. 12. As also shown in FIG. 12, shelf 126 is removably supported on shelf support pan 78 in the manner previously described with respect to shelf 118. As with shelf 118, shelf 126 includes a downwardly depending peripheral lip 133 which receives lip 82 of support pan 78 radially inwardly thereof. The top of lip 82 engages an outwardly extending flange portion 135 connected to lip 133 to provide the necessary support. Support pans 78 used with each shelf 80, 118 and 126 are preferably the same size as are shelves 80, 118, 126 themselves so as to provide for interchangeability and modularity.

Certain advantages of this invention are therefore apparent from the foregoing description of the preferred embodiment thereof. For example, a selected number and variety of shelf assemblies may be used in the display at the point of purchase, such as between to check-out aisles, to display several different individual ice cream novelty products. The modular nature of the shelf assemblies, i.e., the interchangeability of differently configured shelves on a single shelf support, allows the display to be tailored to the needs of the particular supermarket or merchandising facility. Also, the unique design of each shelf allows a large number of individual products not only to be held in the display but, unlike prior shelves and displays, to be readily visible to the purchaser at the point of purchase.

While a preferred embodiment of the invention has been disclosed in detail, those of skill in the art will readily recognize many substitutions and modifications to the details provided herein. Applicant therefore intends not to be bound by such details but only to be bound by the scope of the claims appended hereto.

What is claimed is:

1. A merchandising display comprising:

a housing having an enclosed display compartment;

a door mounted to said housing through which access may be gained to said compartment;

a plurality of vertically spaced generally circular modular shelf assemblies supported at peripheral underside portions thereof by said housing and contained within said compartment, said shelf assemblies each including a shelf support and a product shelf, said product shelf resting on said shelf support in a removable manner to allow different product shelves to be selectively attached to said shelf support; and, wherein at least two product shelves each include product receiving portions having differently configured product compartments for holding different types of products.

2. The merchandising display of claim 1 wherein each said shelf support is a generally circular support pan.

3. The merchandising display of claim 2 wherein each said product shelf is a generally circular shelf unit received on top of said support pan.

4. The merchandising display of claim 3 wherein each said support pan includes an upstanding peripheral lip and each said shelf unit includes a downwardly depending peripheral lip, said peripheral lips being disposed adjacent one another in each said shelf assembly.

5. The merchandising display of claim 3 wherein each said shelf assembly is supported for rotation within said display compartment.

6. The merchandising display of claim I wherein each said shelf assembly is supported for rotation within said display compartment.

7. A merchandising display comprising:

a housing having an enclosed display compartment;

a refrigeration unit operatively connected to said compartment;

a door mounted to said housing through which access may be gained to said compartment; and, at least one generally circular shelf supported for rotation within said display compartment, said shelf including first and second differently configured product receiving portions for respectively receiving first and second differently shaped refrigerated or frozen products, wherein said first product receiving portion includes an upper surface having holes for receiving products.

8. The merchandising display of claim 7 wherein said second product receiving portion is a product compartment of said shelf having a bottom surface, a pair of vertical side support surfaces and a stop surface disposed proximate a central area of said shelf, wherein products may be contained within said product compartment between said side support surfaces and said stop surface.

9. A merchandising display comprising:

a housing having an enclosed display compartment;

a refrigeration unit operatively connected to said compartment;

a door mounted to said housing through which access may be gained to said compartment;

at least one generally circular shelf supported for rotation within said display compartment, said shelf including first and second differently configured product receiving portions for respectively receiving first and second differently shaped refrigerated or frozen products, wherein said first product receiving portion includes an upper surface having holes for receiving products and said second product receiving portion is a product compartment of said shelf having a bottom surface, a pair of upstanding side support surfaces and a stop surface disposed proximate a central area of said shelf, said bottom surface being inclined upwardly from approximately said stop surface to the periphery of said shelf, wherein products may be contained within said product compartment between said side support surfaces and said stop surface.

10. A merchandising display comprising:

a housing having an enclosed display compartment;

a refrigeration unit operatively connected to said compartment;

a door mounted to said housing through which access may be gained to said compartment; and, at least one generally circular shelf supported for rotation within said display compartment, said shelf including first and second differently configured product receiving portions for respectively receiving first and second differently shaped refrigerated or frozen products;

wherein one of said product receiving portions is a product compartment of said shelf having a bottom surface, a pair of upstanding side support surfaces and a stop surface disposed proximate a central area of said shelf, said bottom surface being inclined upwardly from approximately said stop surface to the periphery of said shelf, wherein products may be contained within said product compartment between said side support surfaces and said stop surface.

11. A merchandising display comprising:

a housing having an enclosed display compartment;

a refrigeration unit for cooling said compartment;

a door mounted on a front side of said housing through which access may be gained to said display compartment; and, at least one generally circular shelf supported on a pan mounted within said display compartment, said pan having an upstanding edge which removably receives said shelf, said shelf having an upper surface that is inclined downwardly toward a peripheral edge of said shelf and said upper surface including a plurality of holes therein for receiving and displaying refrigerated or frozen products, and said holes having annular flange portions extending from said upper surface and providing side support for said products.

12. The merchandising display of claim 11 wherein said shelf includes a downwardly extending edge removably received adjacent said upstanding edge of said pan.

13. A merchandising display comprising:

a housing having an enclosed display compartment;

a door mounted to said housing through which access may be gained to said display compartment; and, at least one generally circular shelf supported by said housing and contained within said display compartment, said shelf having an upper surface including a plurality of upstanding, radially extending partitions for separating said shelf into adjacent compartments and each partition having a lower edge and an upper edge and two side surfaces, each side surface including a plurality of recesses extending between the lower edge and the upper edge for receiving and displaying product.

14. The merchandising display of claim 13 wherein upper surface portions disposed between adjacent partitions are inclined upwardly toward the periphery of said shelf.

15. The merchandising display of claim 14 wherein said display compartment is operatively connected to a refrigeration unit.

16. The merchandising display of claim 13 wherein said shelf is supported for rotation within said display compartment.

17. The merchandising display of claim 16 wherein said shelf is removably supported on a shelf support mounted within said display compartment.

18. The merchandising display of claim 17 wherein said shelf support is a pan having an upstanding edge that removably receives said shelf.

19. A shelf unit for holding and displaying product in a merchandising display, said shelf unit being generally circular in shape and having an upper surface including a plurality of upstanding, radially extending partitions for separating said shelf into adjacent compartments, and each partition having a lower edge and an upper edge and two side surfaces, each side surface including a plurality of recesses extending between the lower edge and the upper edge for receiving and displaying product.

20. The shelf unit of claim 19 wherein said recesses are shaped generally as part of a cylinder and are thereby adapted to hold generally cylindrical product containers.

21. The shelf unit of claim 20 wherein said shelf unit has three partitions extending radially at positions spaced approximately 120° apart and three of said recesses are located within junctions created between adjacent partitions.

22. The shelf unit of claim 21 wherein upper surface portions disposed between adjacent partitions are inclined upwardly toward the periphery of said shelf unit.

23. The shelf unit of claim 22 wherein said shelf unit is further comprised of a shelf removably supported on a shelf support.

24. The shelf unit of claim 23 wherein said shelf support is a pan having an upstanding edge that removably receives said shelf.

25. The shelf,unit of claim 24 wherein said shelf includes a downwardly extending edge removably received adjacent said upstanding edge of said shelf support.

26. A shelf unit for holding and displaying product in a merchandising display, said shelf unit being generally circular in shape and having a plurality of product receiving compartments, each of said compartments having a bottom surface, a pair of upstanding side support surfaces and a stop surface disposed proximate a central area of said shelf, said bottom surface being inclined upwardly from approximately said stop surface to the periphery of said shelf, wherein products may be contained within each compartment between said side support surfaces and said stop surface.

27. The shelf unit of claim 26 further comprising at least one shelf area disposed between adjacent compartments having a plurality of holes therein for receiving product.

* * * * *